US008805631B2

(12) United States Patent
Rai et al.

(10) Patent No.: US 8,805,631 B2
(45) Date of Patent: Aug. 12, 2014

(54) COMPUTER-IMPLEMENTED SYSTEMS AND METHODS FOR FORECASTING PERFORMANCE OF WATER FLOODING OF AN OIL RESERVOIR SYSTEM USING A HYBRID ANALYTICAL-EMPIRICAL METHODOLOGY

(75) Inventors: Khyati Rai, Sugar Land, TX (US); Arnaldo L. Espinel, Richmond, TX (US); Ganesh C. Thakur, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 510 days.

(21) Appl. No.: 12/911,431

(22) Filed: Oct. 25, 2010

(65) Prior Publication Data

US 2012/0101759 A1 Apr. 26, 2012

(51) Int. Cl.

| | |
|---|---|
| ***G01V 9/00*** | (2006.01) |
| ***G01N 15/08*** | (2006.01) |
| ***E21B 47/00*** | (2012.01) |
| ***G06G 7/48*** | (2006.01) |

(52) U.S. Cl.

USPC ..... 702/85; 702/6; 702/12; 702/179; 702/182; 702/13; 166/250.01; 703/10

(58) Field of Classification Search

USPC ..... 702/6, 12, 13, 179.182; 166/250.01; 703/10

See application file for complete search history.

(56) References Cited

U.S. PATENT DOCUMENTS

| | | | | |
|---|---|---|---|---|
| 4,125,158 | A * | 11/1978 | Waite et al. | 166/270.1 |
| 4,665,988 | A * | 5/1987 | Murphey et al. | 166/295 |
| 6,574,565 | B1 | 6/2003 | Bush | |
| 2006/0224369 | A1 | 10/2006 | Yang et al. | |
| 2007/0016389 | A1 | 1/2007 | Ozgen | |
| 2007/0143025 | A1 | 6/2007 | Valdez et al. | |
| 2007/0143026 | A1 | 6/2007 | Valdez et al. | |
| 2008/0091283 | A1 | 4/2008 | Balci et al. | |
| 2009/0020284 | A1 | 1/2009 | Graf et al. | |
| 2009/0125288 | A1 | 5/2009 | Main et al. | |
| 2009/0299714 | A1 * | 12/2009 | Kelkar et al. | 703/10 |
| 2010/0300682 | A1 * | 12/2010 | Thakur et al. | 166/250.01 |
| 2011/0168391 | A1 * | 7/2011 | Saleri et al. | 166/250.15 |

OTHER PUBLICATIONS

Benton et al., "Early Implementation of a Full- Scale Waterflood in the Abo Reef, Terry Co., TX—A case History", SPE9475, Amer. Instit. of Mining, Metall. and Petro. Eng (1980).

(Continued)

*Primary Examiner* — Janet Suglo
*Assistant Examiner* — L. Anderson
(74) *Attorney, Agent, or Firm* — Jones Day

(57) ABSTRACT

Computer-implemented systems and methods are provided for generating corrected performance data of water flooding of an oil reservoir system based on application of a statistical correction factor methodology (SCF). For example, data related to properties of the oil reservoir system and data related to a water flooding scenario are received. Water flooding performance data is generated based on application of an analytical water flooding performance computation methodology. Based on application of the SCF methodology to the generated water flooding performance data, corrected water flooding performance data is determined, representative of oil recovery by the water flooding of the oil reservoir system. The SCF methodology can also be used to evaluate water production based on parameters such as water-oil ratio and water cut, identify possible analog reservoirs that have similar water production performance, and calculate a Gross Injection Factor to account for water loss in the reservoir.

21 Claims, 17 Drawing Sheets

(56) References Cited

OTHER PUBLICATIONS

Bush et al., "Empirical Prediction of Recovery Rate in Waterflooding Depleted Sands", SPE2109, SPE Eighth Secondary Recovery Symposium, Wichita Falls (May 6-7, 1968), pp. 933-943.
Snyder et al., "Application of Buckley-Leverett Displacement Theory to Noncommunicating Layered Systems", J. Petrol. Tech. (Nov. 1967), pp. 1500-1506.
El-Khatib, "The Application of Buckley-Leverett Displacement to waterflooding in Non-Communicating Stratified Reservoirs", SPE 68076, Society of Petroleum Engineers (2001).
Craig, "Predicting Waterflood Performance", from Reservoir Engineering Aspects of Waterflooding, SPE Monograph Series vol. 3 (1993), pp. 81-82.
Craig et al., "Oil Recovery Performance of Pattern Gas or Water Injection Operations from Model Tests", vol. 204 Petroleum Transactions (1955), pp. 7-15.
Dykstra, H. And Parsons, R. L: The Prediction of Oil Recovery by Water Flood, Secondary Recovery of Oil in the United States, pp. 160-174, American Petroleum Institute, New York, 1950, 2nd Ed.
Stiles, "Use of Permeability Distribution in Water Flood Calculations", T.P. 2513, Petroleum Transactions, AIME (Jan. 1949), pp. 9-13.
Dyes et al., "Oil Production After Breakthrough—as Influenced by Mobility Ratio", T.P. 3784, Petroleum Transactions, AIME (Apr. 1954), pp. 27-32.
U.S. Appl. No. 12/472,920, filed May 27, 2009, by Ganesh Thakur, et al.
PCT Application PCT/US2010/036158, filed on May 26, 2010, by Arnaldo L. Espinel, et al.
Thakur et al., "Integrated waterflood asset management", PennWell Publishing Co. (1998).
PCT Application Serial No. PCT/US2011/054718, filed Oct. 4, 2011, Notification of Transmittal of the International Search Report and the Written Opinion of the International Searching Authority received from the Korean Intellectual Property Office, dated Apr. 24, 2012.

* cited by examiner

COMPUTER-IMPLEMENTED SYSTEMS AND METHODS FOR FORECASTING PERFORMANCE OF WATER FLOODING OF AN OIL RESERVOIR SYSTEM USING A HYBRID ANALYTICAL-EMPIRICAL METHODOLOGY

FIELD

The present disclosure generally relates to computer-implemented systems and methods for analyzing a reservoir system, and more particularly to forecasting the performance of a reservoir system with application of a water flooding process.

BACKGROUND

Water flooding is an improved oil recovery technique. Typically, water flooding involves the injection of water into an injection well, to cause oil that was not recovered during primary production to be displaced by water and move through the reservoir rock and into the wellbores of one or more adjacent production wells. Many factors may affect the performance of an oil reservoir system in the application of a water flooding process, including areal and vertical sweep efficiencies, water flooding displacement efficiency, continuity and heterogeneity of the oil reservoir system, mobility ratio, rock and fluids properties and saturations, remaining oil saturation after primary recovery, and reservoir pressure level. Predictions of realistic performance of an oil reservoir system with application of a water flooding process constitute useful information for supporting analysis of project feasibility and for other purposes.

SUMMARY

As disclosed herein, computer-implemented systems and methods are provided for forecasting the performance of water flooding of an oil reservoir system. For example, data related to properties of an oil reservoir system and data related to a water flooding scenario are received. Water flooding performance data is generated based on application of at least one water flooding performance computation methodology to the data related to properties of the oil reservoir system and the data related to the water flooding scenario. Based on application of an empirical water flooding performance computation methodology to the generated water flooding performance data, corrected water flooding performance data is determined, representative of oil recovery by the water flooding of the oil reservoir system.

In some embodiments, the corrected water flooding performance data is compared to actual field performance or reservoir simulation results. General guidelines for water flood recovery expectations in terms of dimensionless reservoir parameters, such as recovery factor (RF) and pore volumes injected (PVI), can then be developed for the field.

As another example, a computer-implemented system and method having one or more data processors can be configured such that data related to properties of the oil reservoir system and data related to a water flooding scenario are received. Water flooding performance data is generated based on application of at least one analytical water flooding performance computation methodology to the data related to properties of the oil reservoir system and the data related to the water flooding scenario. Based on application of a statistical correction factor (SCF) methodology to the generated water flooding performance data, corrected water flooding performance data is determined, representative of oil recovery by the water flooding of the oil reservoir system.

In some embodiments, the corrected water flooding performance data is compared to actual field performance or reservoir simulation results. General guidelines for water flood recovery expectations in terms of dimensionless reservoir parameters, such as recovery factor (RF) and pore volumes injected (PVI), can then be developed for the field.

As another example, a computer-implemented system and method can be configured such that data related to properties of an oil reservoir system and data related to a water flooding scenario are received. Water flooding performance data including recovery efficiency are generated by numerical simulations based on the data related to properties of the oil reservoir system and the data related to the water flooding scenario. A first value of volumetric sweep efficiency is determined from the generated recovery efficiency based on a correlation of volumetric sweep efficiency as a function of recovery efficiency. A second value of volumetric sweep efficiency is determined based on predetermined correlations of areal sweep efficiency and vertical sweep efficiency. Whether the first value of volumetric sweep efficiency is reasonable is determined based on the second value of volumetric sweep efficiency. Estimates of recovery efficiency (low, mid, high) can be generated using the second value of volumetric sweep efficiency.

As another example, a computer-implemented system and method can be configured such that data related to properties of an oil reservoir system and data related to a water flooding scenario are received. Water flooding performance data is generated based on application of at least one analytical water flooding performance computation methodology to the data related to properties of the oil reservoir system and the data related to the water flooding scenario. Based on application of a statistical correction factor (SCF) methodology to the generated water flooding performance data, corrected water flooding performance data including recovery efficiency (SCF $E_R$) are determined. Water flooding performance data including recovery efficiency (simulated $E_R$) are generated by numerical simulations based on the data related to properties of the oil reservoir system and the data related to the water flooding scenario. Additionally, at least one recovery efficiency value (analytical $E_R$) is determined based on predetermined correlations of areal sweep efficiency and vertical sweep efficiency. Whether the analytical $E_R$ is reasonable is determined based on the SCF $E_R$ and the simulated $E_R$. Or whether the simulated $E_R$ is reasonable is determined based on the analytical $E_R$ and the SCF-$E_R$. In some embodiments, at least one recovery efficiency value (analytical $E_R$) is determined based on actual field performance, and compared to analytical, simulation and statistical results.

BRIEF DESCRIPTION OF THE DRAWINGS

FIG. 8 shows a plot of water-oil ratio (WOR) versus recover factor (RF).

FIG. 9 shows a plot of water cut versus recover factor (RF).

FIG. 10 shows a plot of water-oil ratio versus pore volumes injected.

FIG. 11 shows a plot of water cut versus pore volumes injected.

FIGS. 12 and 13 compare the water production performance of reservoir 805 and reservoir 807.

FIGS. 14 and 15 compare the water production performance of reservoir 807 and reservoir 809.

DETAILED DESCRIPTION

Figure 1:
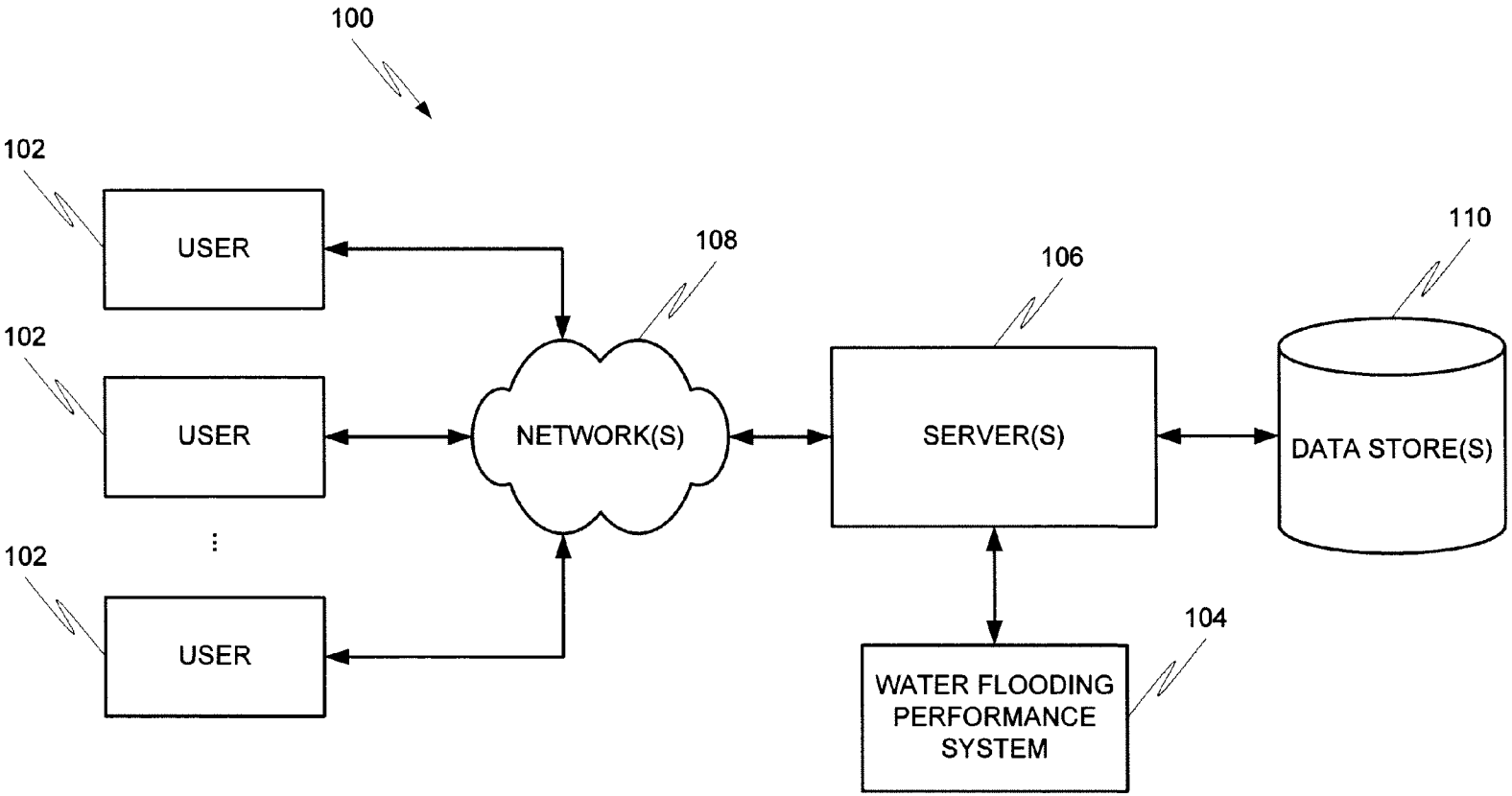
FIG. 1 depicts a computer-implemented environment wherein users can interact with water flooding performance system hosted on one or more servers through a network.

FIG. 1 depicts computer-implemented environment 100 wherein users 102 can interact with water flooding performance system 104 hosted on one or more servers 106. Water flooding performance system 104 can provide predictions of oil recovery for water flooding of an oil reservoir system. The predictions can be useful for many different situations, such as obtaining an estimate of water flood performance (e.g., estimates of recovery efficiency, volumetric sweep efficiency, etc.).

Users 102 can interact with water flooding performance system 104 through a number of ways, such as over one or more networks 108. One or more servers 106 accessible through network(s) 108 can host water flooding performance system 104. One or more servers 106 have access to one or more data stores 110 which store input data, intermediate results, and output data for water flooding performance system 104.

Water flooding performance system 104 may implement analytical and empirical water flooding performance computation methodologies for predictions of oil recovery for water flooding of an oil reservoir system. Examples of analytical methodologies include the Buckley-Leverett methodology (BL), the Craig-Geffen-Morse methodology (CGM), the Dykstra-Parsons methodology (DP), and the Stiles methodology. Examples of empirical methodologies include the Bush-Helander (BH) methodology and the Statistical Correction Factor (SCF) methodology, which are based on a large set of actual water flooding performance data. Each methodology may have its own applicability criteria. For example, the DP methodology and the Stiles methodology may be more suitable for stratified reservoirs. The BL methodology and the CGM methodology may be more appropriate for less stratified reservoirs.

Moreover, the system 104 may implement a hybrid analytical-empirical methodology to determine the performance of an oil reservoir system. For example, the SCF methodology may be used together with an analytical water flooding performance computation methodology to provide more realistic production profiles based on field statistics and real field responses.

Figure 2:
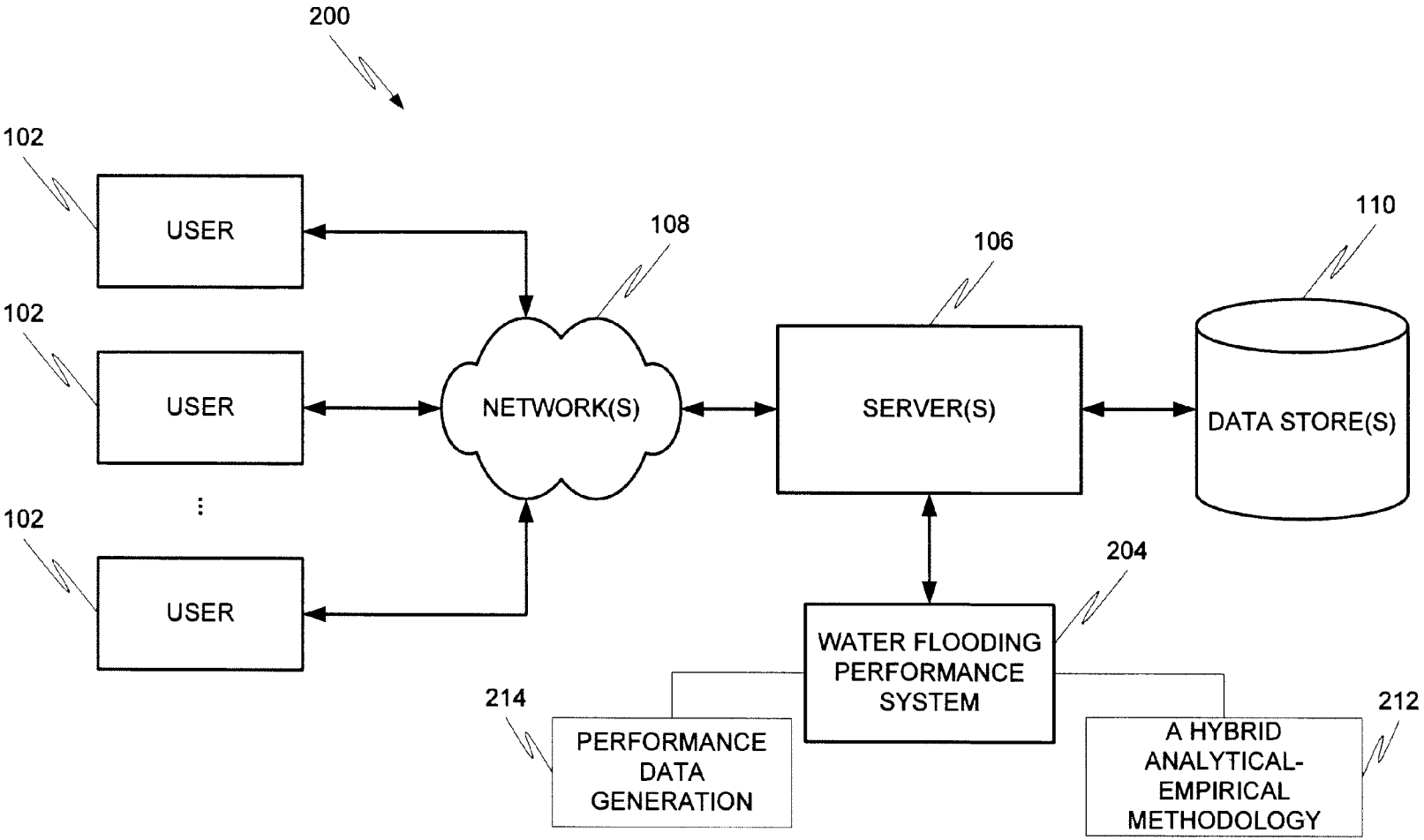
FIG. 2 depicts an example of a computer-implemented environment wherein water flooding performance system implements a hybrid analytical-empirical methodology for performance data generation.

FIG. 2 illustrates computer-implemented environment 200 wherein water flooding performance system 204 can be configured to implement a hybrid analytical-empirical methodology for performance data generation. Users 102 can interact with water flooding performance system 204 hosted on one or more servers 106. Water flooding performance system 204 implements a hybrid analytical-empirical methodology, such as an SCF methodology together with an analytical computation methodology, at 212 for water flooding performance data generation at 214.

Figure 3:
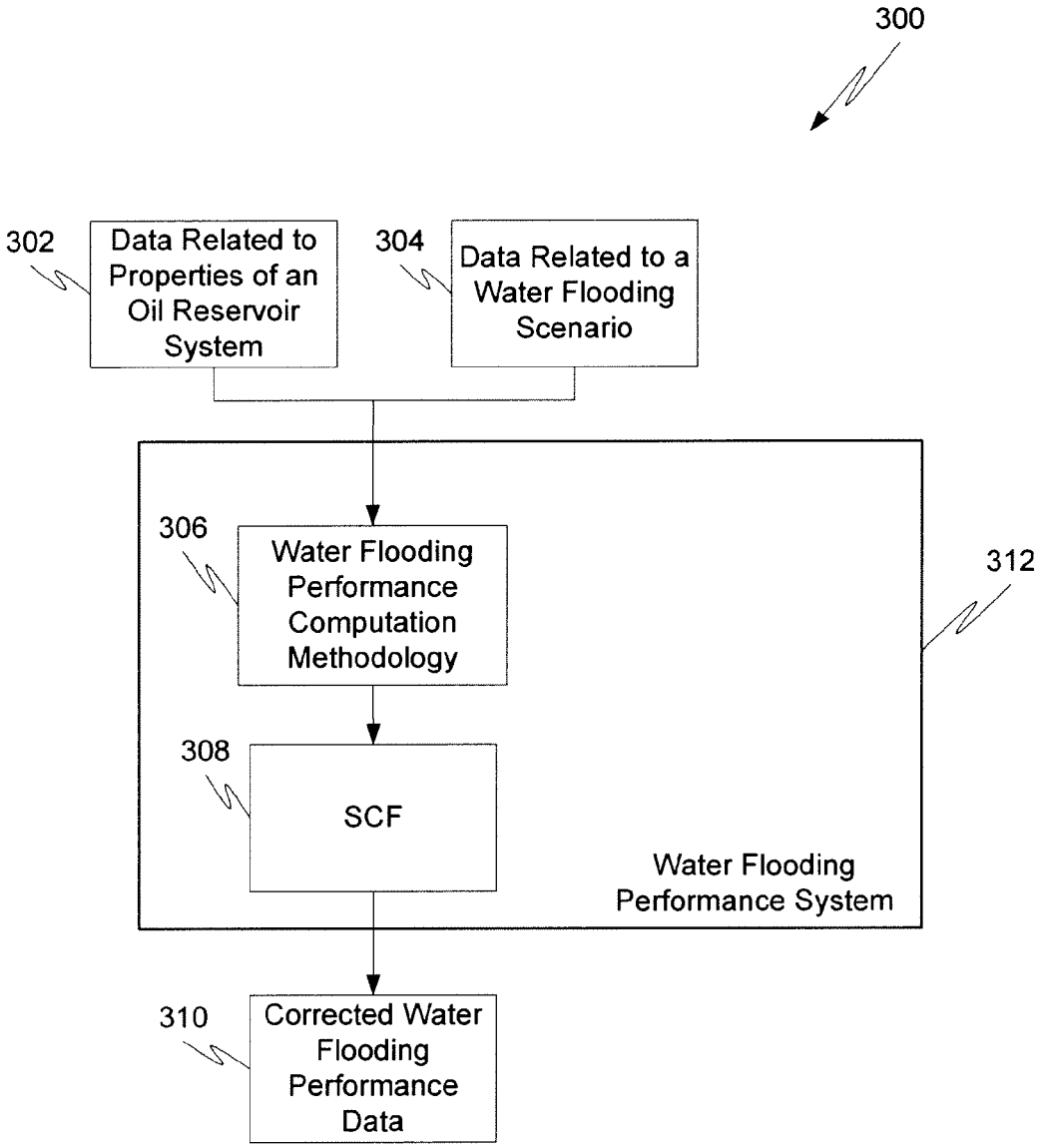
FIG. 3 is a block diagram depicting an example of water flooding performance system implementing an SCF approach.

The approaches discussed herein can be modified or augmented in many different ways. As an example, FIG. 3 is a block diagram 300 depicting an example of water flooding performance system 312, which implements a hybrid analytical-empirical methodology using the SCF methodology 308 together with analytical water flooding performance computation methodology 306. Data related to properties of an oil reservoir system 302 and data related to water flooding scenario 304 are received. As shown at 306, at least one analytical water flooding computation methodology 306 can be applied to the received data to generate water flooding performance data. As shown at 308, the SCF methodology can be applied to the generated water flooding performance data to obtain more realistic (e.g., more accurate) results. Consequently, corrected water flooding performance data is generated at 310, representative of oil recovery by the water flooding of the oil reservoir system.

The data related to properties of the oil reservoir system 302 may include water saturation, residual saturation, residual oil saturation, residual gas saturation, initial oil saturation, initial gas saturation, initial water saturation, oil viscosity, oil formation volume factor, pattern area, reservoir thickness (net and/or gross), porosity, the distance between wells, reservoir pressure drop, the number of reservoir layers, average permeability, transmissibility, and reservoir pressure. The data related to a water flooding scenario 304 may include data related to the properties of the water used in the water flooding of the oil reservoir system, and injection data of the water flooding into the oil reservoir system.

The SCF methodology can be applied in various ways and results in different corrections to the water flooding performance data generated by the at least one analytical water flooding performance computation methodology. For example, the application of the SCF methodology may result in a forecasted delay of the time for initial oil production and a reduction of the oil production rate. Such an SCF correction to the water flooding performance data may be determined based on application of an empirical methodology, such as the BH methodology, to the received data related to properties of the oil reservoir system and the received data related to the water flooding scenario.

The original BH methodology was presented in "Empirical Prediction of Recovery Rate in Waterflooding Depleted Sands," James L. Bush et al., SPE Eighth Secondary Recovery Symposium, 1968 (SPE paper 2109). The original BH methodology can be modified to account for mobility ratio and Dykstra-Parsons coefficients. The application of the modified BH methodology involves assigning one of the three recovery cases: maximum recovery case, average recovery case, and minimum recovery case. The criteria for assigning a recovery case are developed based on the received mobility ratios (MR) and Dykstra-Parsons coefficients ($V_{DP}$):

| | |
|---|---|
| $MR \leq 1, V_{DP} \leq 0.8$ | Maximum recovery |
| $MR > 1, V_{DP} > 0.8$ | Minimum recovery |
| All other cases | Average recovery |

The following parameters are calculated based on the assigned recovery case and the empirical relations disclosed in the SPE paper 2109: the time from initial injection to the beginning of oil production, the time of peak oil production, the total life of the flood, the time required to produce 50% and 75% of the ultimate recovery factor (URF), the oil production rates at 50% and 75% of the URF, and the peak oil rate.

As a result, the SCF corrected time for initial oil production response may be determined according to the following equation:

$$t_{response}=t_{AM}+t_{BHi},$$

where $t_{response}$ is the SCF corrected time for initial oil production response, $t_{AM}$ is the time for initial oil production determined using the at least one analytical water flooding performance computation methodology, $t_{BHi}$ is the time for initial oil production determined using the modified BH methodology.

The SCF corrected oil production rate may be determined according to the following equations:

$$q=\begin{cases} q_{shaved}=\dfrac{2q_{AM}}{3} & t_{response}<t_{AMmax}+t_{BHi} \\ q_{shaved}=\dfrac{2q_{AMmax}}{3} & t_{AMmax}+t_{BHi}\leq t_{response}\leq t_{BHpeak} \\ q_{shaved}=\dfrac{2q_{AM}}{3} & t_{response}>t_{BHpeak}, \end{cases}$$

where $q_{shaved}$ is the SCF corrected oil production rate, $q_{AM}$ is the oil production rate determined using the at least one analytical water flooding performance computation methodology, $t_{AMmax}$ is the time for oil production rate to peak determined using the at least one analytical water flooding performance computation methodology, $t_{BHpeak}$ is the time for oil production rate to peak determined using the BH methodology.

Figure 4:
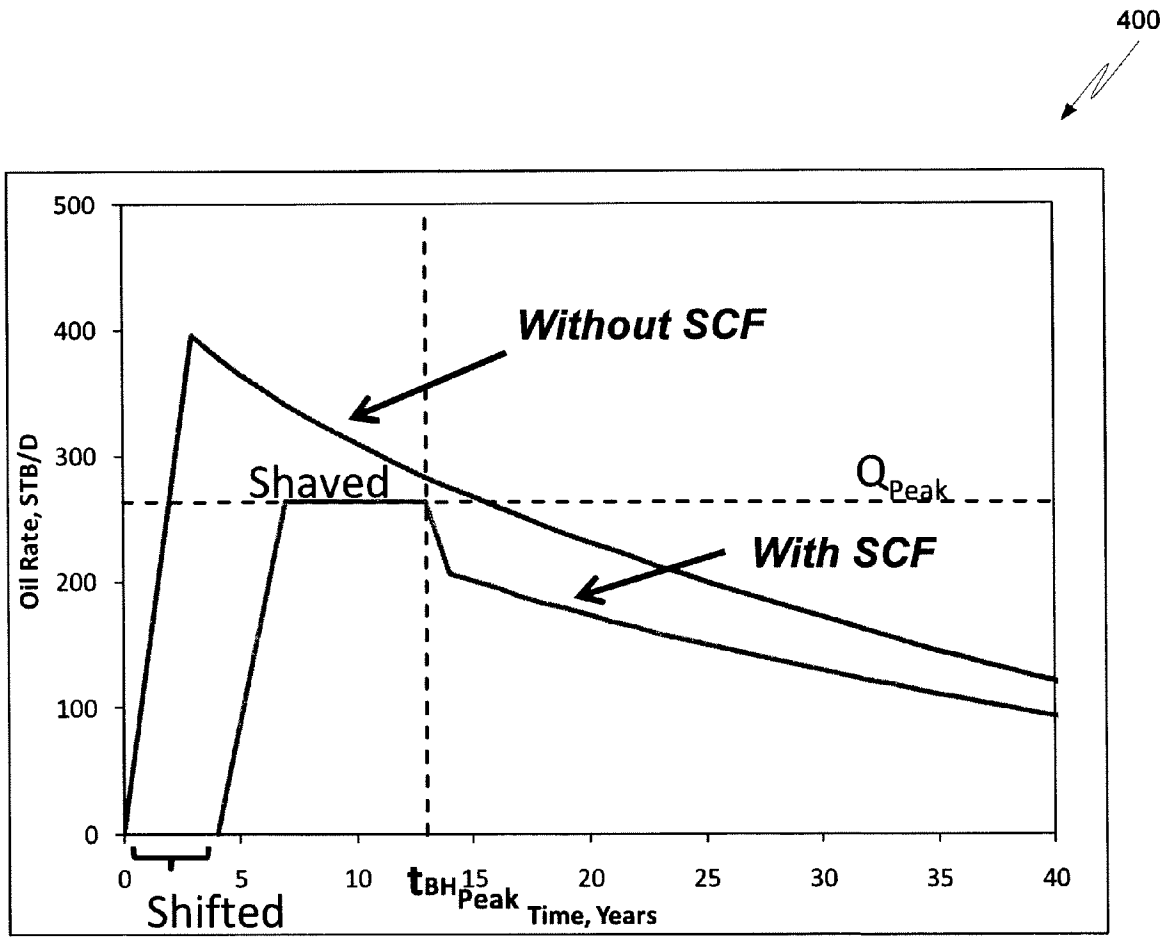
FIG. 4 shows a comparison of example performance data of water flooding without applying an SCF methodology and example corrected performance data of water flooding with the application of an SCF methodology.

FIG. 4 shows a comparison of example performance data of water flooding without applying the SCF methodology and example corrected performance data of water flooding with the application of the SCF methodology. As shown in FIG. 4, the time for initial oil production is delayed to be equal to that obtained using the modified BH methodology. The oil production rate profile is shaved approximately ⅓$^{rd}$ depending on the production peak reached by the analytical method and the BH method to obtain more realistic results. The shaved oil production rate profile is a function of the time of peak production obtained using the modified BH methodology. An oil production rate plateau until the time to peak $t_{BHpeak}$ is shown in FIG. 4.

Figure 5:
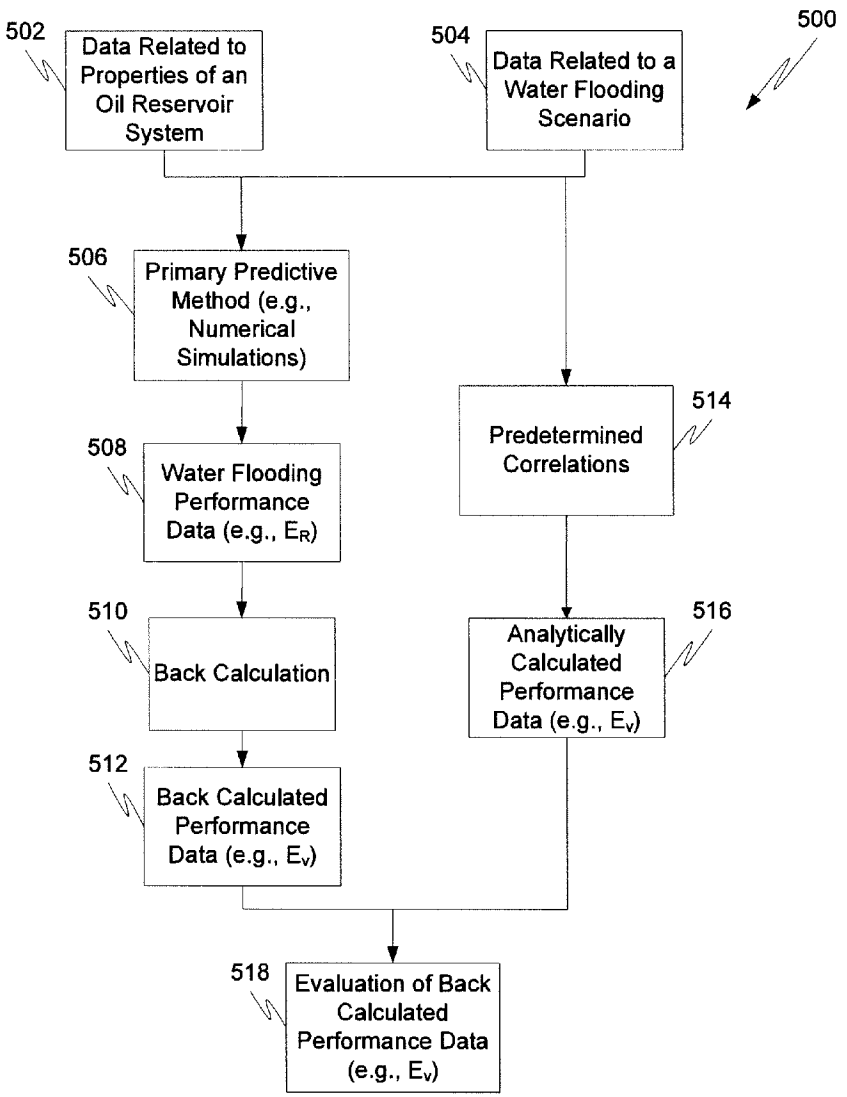
FIG. 5 is a flow diagram depicting an example of an evaluation process of back calculated performance data.

A back calculation methodology may be used to evaluate and support results obtained from a primary predictive method, such as numerical simulations. For example, FIG. 5 depicts an example of evaluation process 500 of back calculated performance data. Data related to properties of oil reservoir system 502 and data related to water flooding scenario 504 are received. As shown at 506, a primary predictive method, such as numerical simulations, is applied to the received data. As a result, water flooding performance data including recovery efficiency are generated at 508. A volumetric sweep efficiency $E_v$ can be back calculated at 510 based on the generated recovery efficiency $E_R$ using the following equation:

$$E_R=E_D*E_v$$

where $E_D$ is the displacement efficiency.

The displacement efficiency $E_D$ can be calculated from the following equation, assuming reservoir pressure is reasonably constant:

$$E_D=1-(S_{or}/S_{oi})$$

where $S_{oi}$ is the initial oil saturation at the beginning of the water flooding process, $S_{or}$ is the residual oil saturation remaining after the water flooding process.

To determine whether back calculated performance data 512, e.g., $E_v$, is reasonable, predetermined correlations 514 can be used to obtain analytically calculated performance data 516, which can be used for comparison with the back calculated performance data 512. For example, predetermined correlations of areal sweep efficiency $E_A$ and vertical sweep efficiency $E_i$ can be used to obtain an analytically calculated volumetric sweep efficiency based on the following equation:

$$E_v=E_A*E_i$$

Predetermined correlations of $E_A$ and $E_i$ can be published correlations. For example, correlations to estimate $E_A$ for different displaceable volumes injected ($V_d$) are provided in "Oil Production after Breakthrough—as Influenced by Mobility Ratio," A. B. Dyes, B. H. Caudle, and R. A. Erickson, *Trans.*, AIME, Vol. 201, 1954. Correlations to estimate $E_i$ for different Dykstra-Parsons coefficients ($V_{DP}$) are provided in "The Prediction of Oil Recovery by Water Flood," H. Dykstra and R. L. Parsons, *Secondary Recovery of Oil in the United States*, 2$^{nd}$ Ed., API, New York, N.Y., 1950. Based on these published correlations, $E_A$ and $E_i$ can be calculated to determine an analytically calculated $E_v$. An evaluation of back calculated $E_v$ can be provided at 518 to determine whether the back calculated $E_v$ is reasonable based on the analytically calculated $E_v$. If the back calculated $E_v$ is close to or within a predetermined range of the analytically calculated $E_v$, then water flooding performance data 508 generated using primary predictive method 506 is considered to be reasonable. If the back calculated $E_v$ is neither close to nor within a predetermined range of the analytically calculated $E_v$, then a new estimate of recovery efficiency $E_R$ can be generated using the analytically calculated volumetric sweep efficiency $E_v$ and the displacement efficiency $E_D$. Further, new estimates for low case, mid case, and high case recovery efficiencies can be generated by varying the displaceable volumes injected ($V_d$), such as $V_d$=0.50, $V_d$=1.00, and $V_d$=1.50, respectively.

Figure 6:
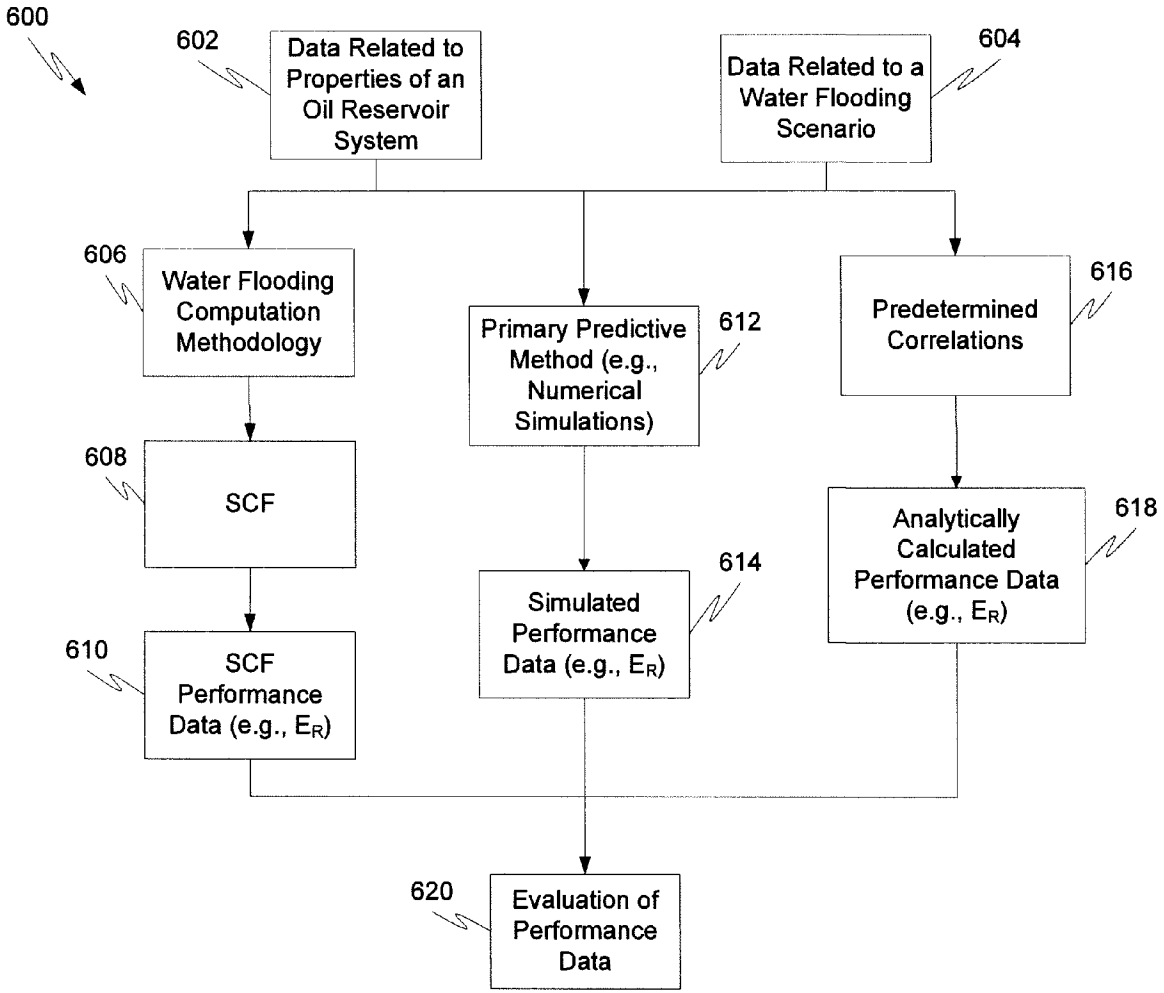
FIG. 6 is a flow diagram depicting an example of an evaluation process of performance data determined by different methods.

Performance data of water flooding determined by different methods may be evaluated based on comparison of these performance data. FIG. 6 is a flow diagram depicting an example of an evaluation process 600 of performance data determined by different methods. Among the performance data of water flooding determined by different methods, recovery efficiency is used as an example in the following discussion to illustrate the evaluation process.

Data related to properties of an oil reservoir system 602 and data related to a water flooding scenario 604 are received. As shown at 606, at least one analytical water flooding computation methodology can be applied to the received data to generate water flooding performance data. As shown at 608, the SCF methodology can be applied to the generated water flooding performance data to obtain more realistic results. Consequently, corrected water flooding performance data including a recovery efficiency (SCF $E_R$) are determined at 610.

As shown at 612, a primary predictive method, such as one using numerical simulations, is applied to the received data related to properties of an oil reservoir system 602 and the data related to a water flooding scenario 604. As a result, water flooding performance data including a recovery efficiency (simulated $E_R$) are generated at 614.

As shown at 616, predetermined correlations of specific parameters, such as published correlations of areal sweep efficiency $E_A$ and vertical sweep efficiency $E_i$, can be used to obtain analytically calculated performance data including a recovery efficiency (analytical $E_R$) at 618 based on the following equation:

$$E_R=E_D*E_A*E_i$$

A range of analytical recovery efficiencies ($E_R$) may be determined by varying parameters such as pore volumes injected.

At 620, performance data, e.g., $E_R$, determined from one method can be evaluated based on performance data determined from other methods. For example, whether the analytical $E_R$ is reasonable can be determined by comparing the analytical $E_R$ with the SCF $E_R$ and the simulated $E_R$. Or whether the simulated $E_R$ is reasonable can be determined by comparing the simulated $E_R$ with the analytical $E_R$ and the SCF $E_R$.

Figure 7B:
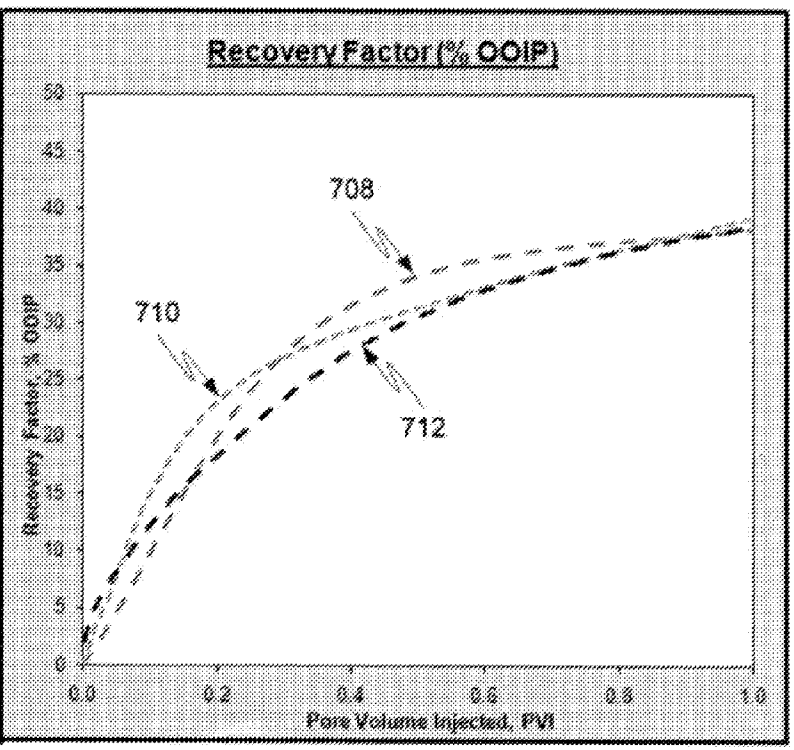
FIGS. 7A and 7B show comparisons of example performance data determined by different methods.
Figure 7A:
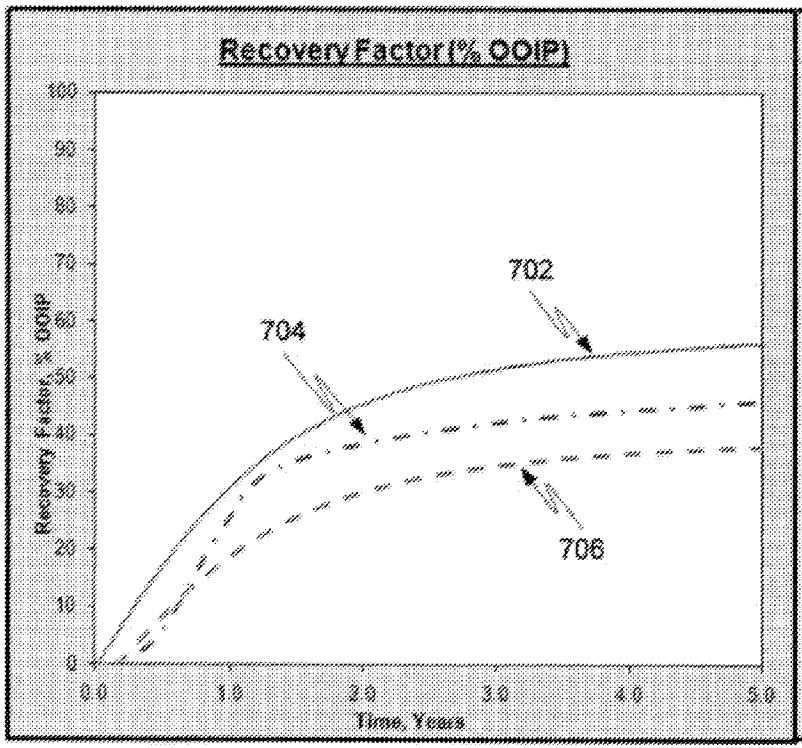

FIGS. 7A and 7B show comparisons of example performance data determined by different methods. As shown in FIG. 7A, over time, the recovery factor determined by the CGM methodology 702 is higher than that determined by the BH methodology 704. Further, the recovery factor determined by the BH methodology 704 is higher than the recovery factor determined by the CGM methodology with the application of the SCF methodology 706.

As shown in FIG. 7B, plotted against pore volume injected, the recovery factor determined by the CGM methodology with the application of the SCF methodology 708 is close to the recovery factor determined by numerical simulation 710 and the actual field data 712. Thus, the CGM methodology, as well as other analytical methodologies, may be too optimistic in estimating the oil recovery performance of water flooding, while the application of the SCF methodology provides more realistic performance data.

Water flooding performance system 104 can also be used to more accurately evaluate water production based on parameters such as water-oil ratio (WOR) and water cut (WC). For example, the water-oil ratio can be calculated as the ratio of an analytically calculated water production rate ($q_{total}$) to the analytically calculated oil production rate corrected by application of the statistical correction factor methodology ($q_{oSCF}$). Water cut can be calculated as the ratio of an analytically calculated water production rate ($q_{wtotal}$) to the sum of the analytically calculated water production rate ($q_{wtotal}$) and the analytically calculated oil production rate corrected by application of the SCF methodology ($q_{oSCF}$). The values of water-oil ratio ($q_{wtotal}/q_{oSCF}$) and water cut ($q_{wtotal}/(q_{wtotal}+q_{oSCF})$) can be compared with the values estimated from reservoir simulation results, actual field data, or a combination thereof. In some embodiments, the comparison is made "shifting" the data from values of water-oil ratio and water cut of 0.01 or less to 0.1 as values lower than 0.1 typically present incorrectly measured values. For example, a comparison can be made in the traditional plots of water-oil ratio (log scale) and water cut (Cartesian scale) versus pore volumes injected (Cartesian scale) such that the values of water-oil ratio and water cut of 0.1 are assigned to the pore volume injected at water breakthrough eliminating values below 0.1. Similarly, a comparison can be made in the traditional plots of water-oil ratio and water cut versus recovery factor such that the values of water-oil ratio and water cut of 0.1 are assigned to the recovery factor at water breakthrough eliminating values below 0.1.

Differences between water production curves generated using simulation or actual field performance data and those generated using water flooding performance system 104 can be indicative of problems in the reservoirs. For example, such problems can include water fingering, water cycling, the existence of high permeability zones, water injected that is not affecting the reservoir, or a combination thereof. Accordingly, these plots can be used for diagnostics to compare analytical behavior to actual behavior, and determine possible operational problems. Furthermore, these plots can be used to identify opportunities for waterflood optimization and possible analog reservoirs with similar water production performance.

Figure 8:
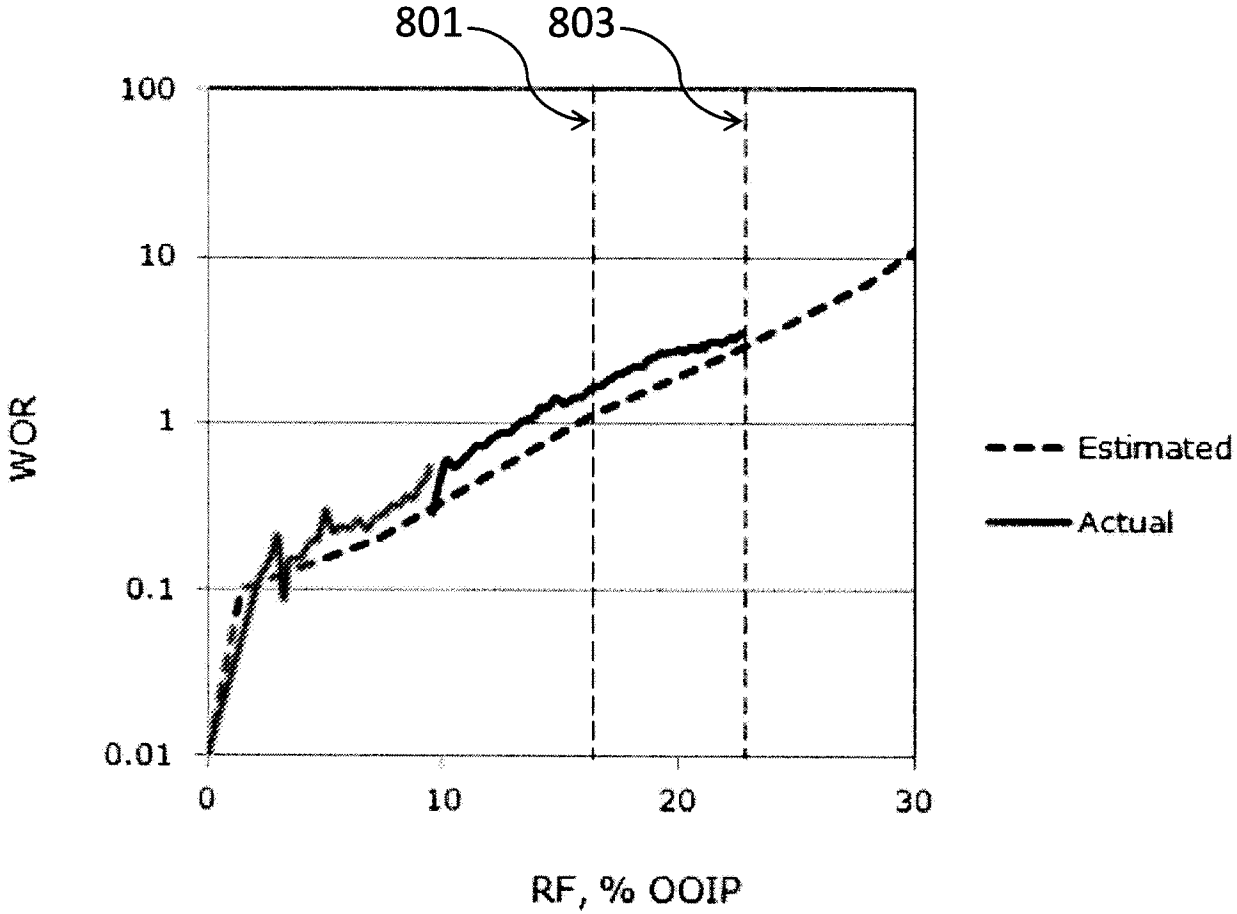
FIGS. 8-11 compare water production values obtained using the water flooding performance system to actual field data.
Figure 9:
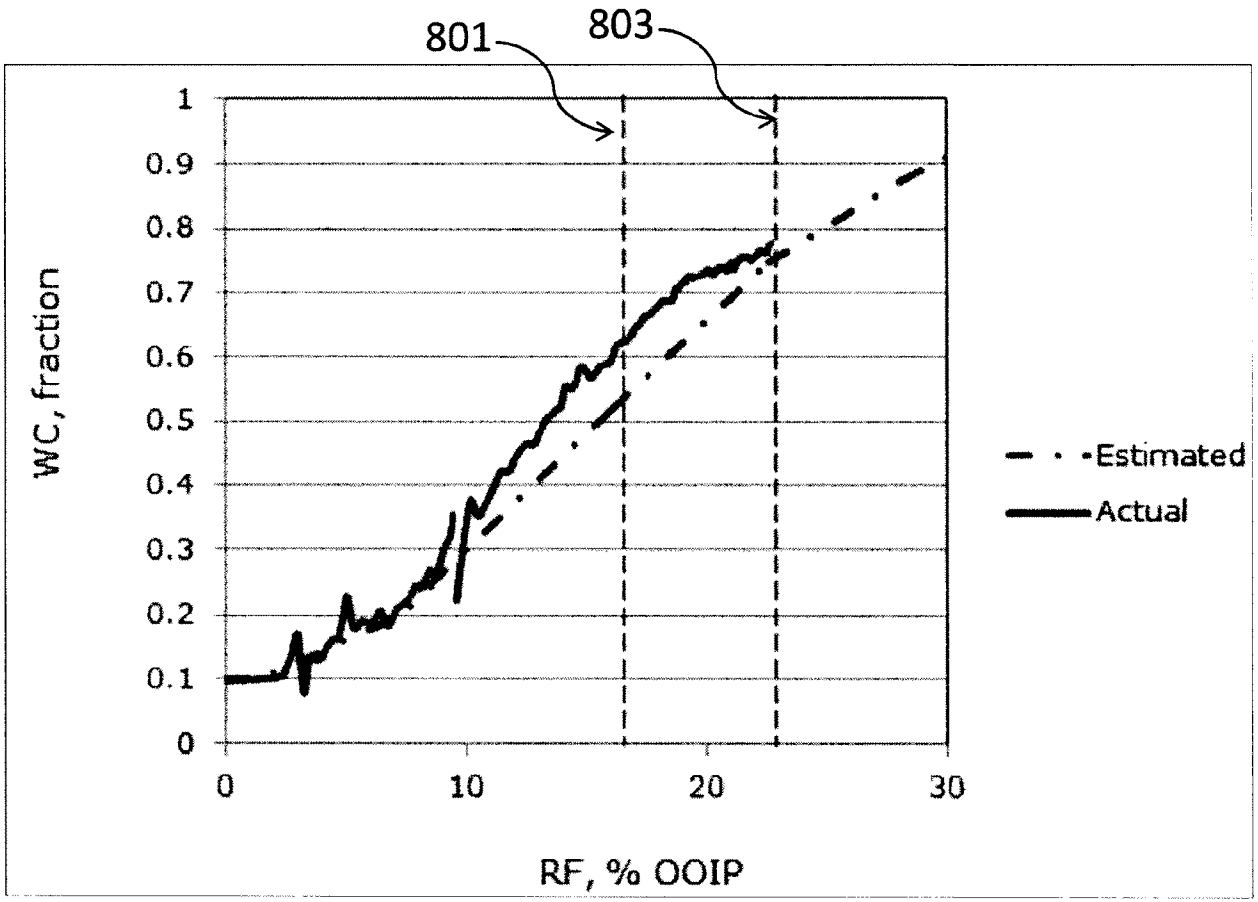
Figure 10:
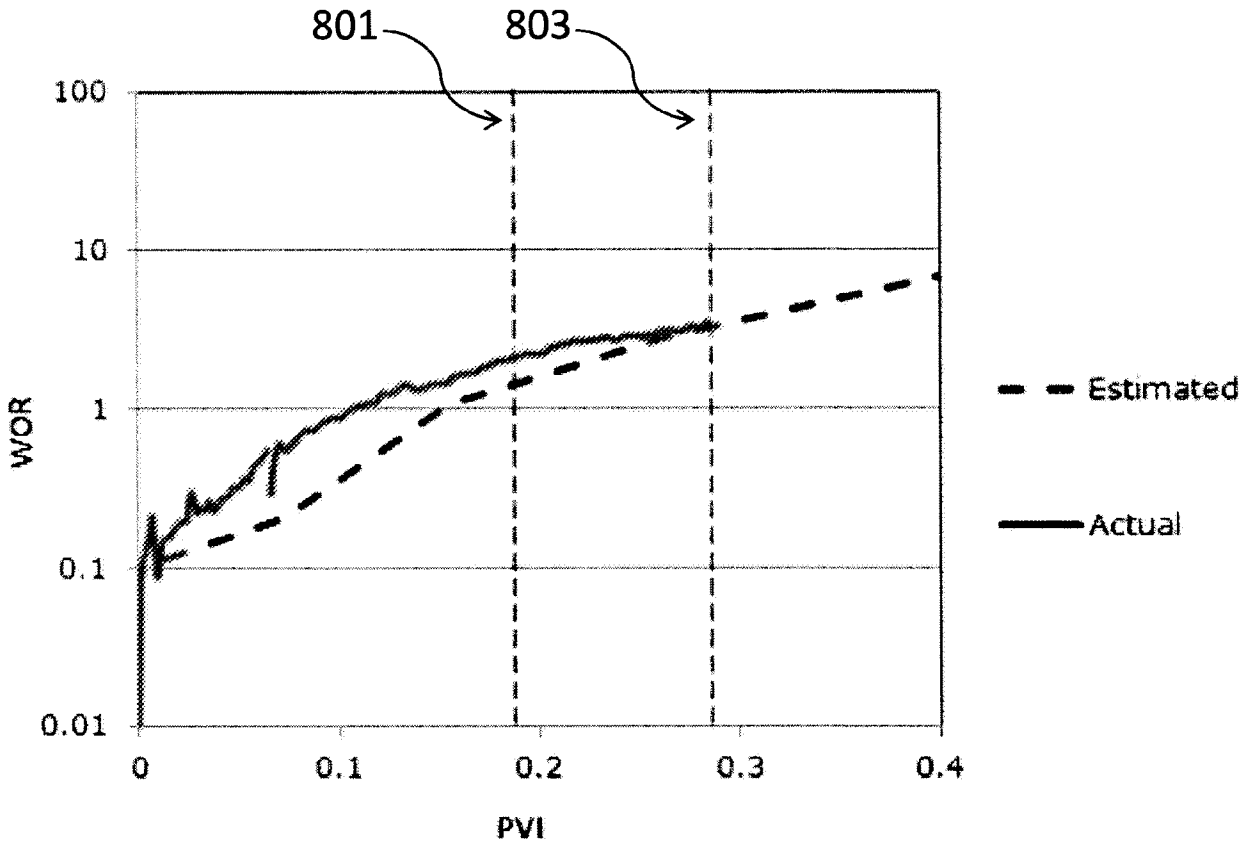
Figure 11:
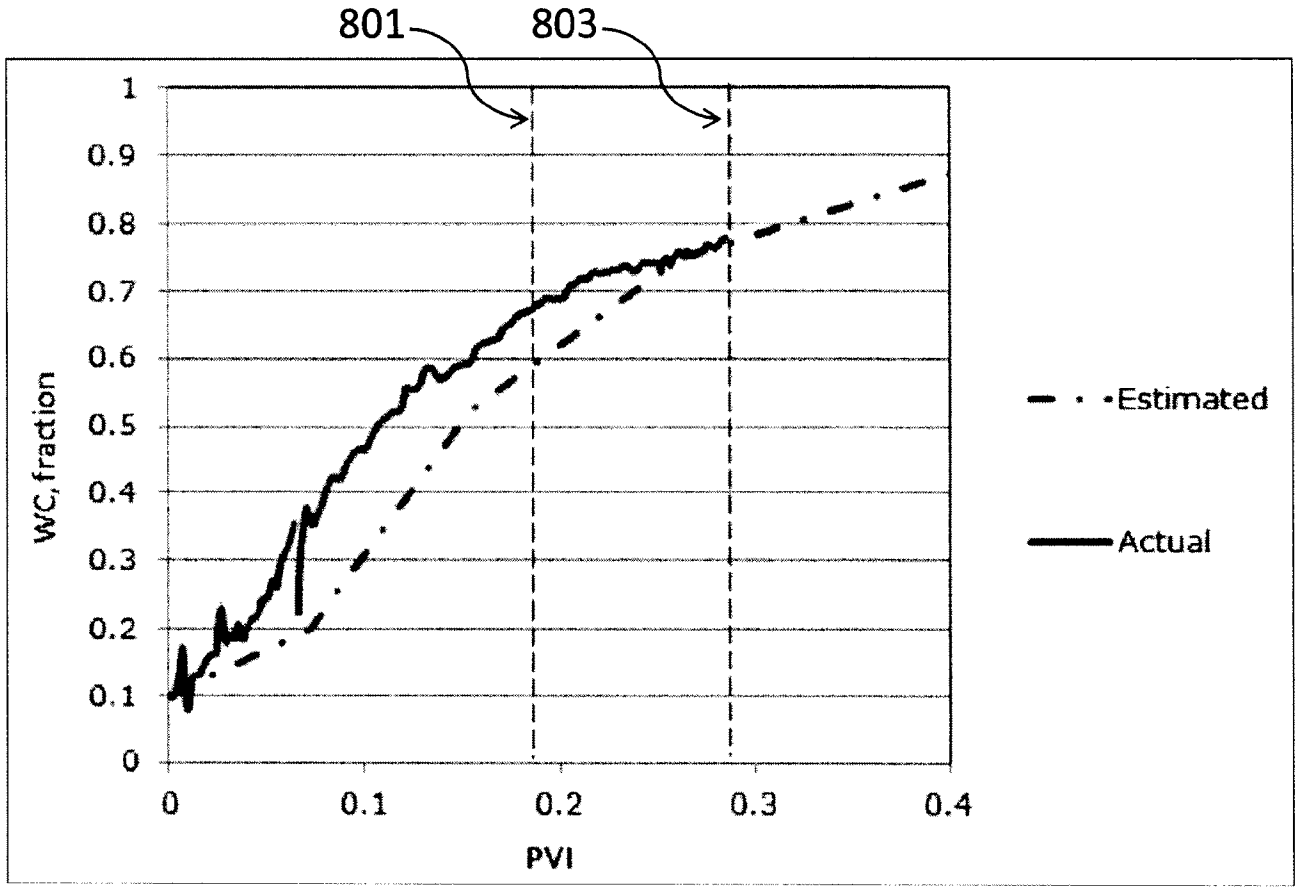

FIGS. 8-11 compare water production values obtained using the water flooding performance system 104 to actual field data. In particular, FIG. 8 shows a plot of water-oil ratio (WOR) versus recover factor (RF). FIG. 9 shows a plot of water cut versus recover factor (RF). FIG. 10 shows a plot of water-oil ratio versus pore volumes injected. FIG. 11 shows a plot of water cut versus pore volumes injected. In each of these plots, differences can be observed between the water production curves generated using actual field performance data and those estimated using water flooding performance system 104. Water injection realignment is performed at 801 to correct the operational problems identified by the diagnostics. The water-oil ratio and water cut curves generated using actual field performance data trend towards matching the water production curves estimated using water flooding performance system 104 after water injection realignment is performed as shown at 803.

Figure 12:
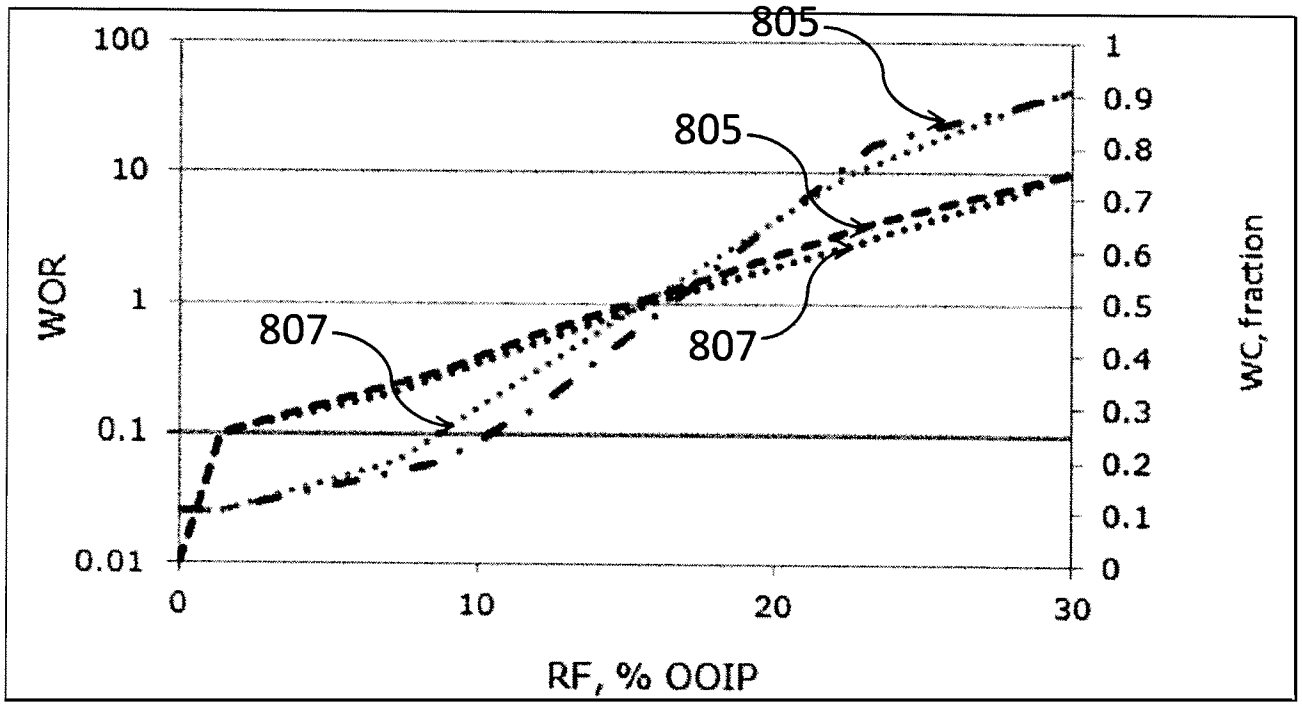
FIGS. 12-15 illustrate how a water flooding performance system can be used to identify possible analog reservoirs with similar water production performance.
Figure 13:
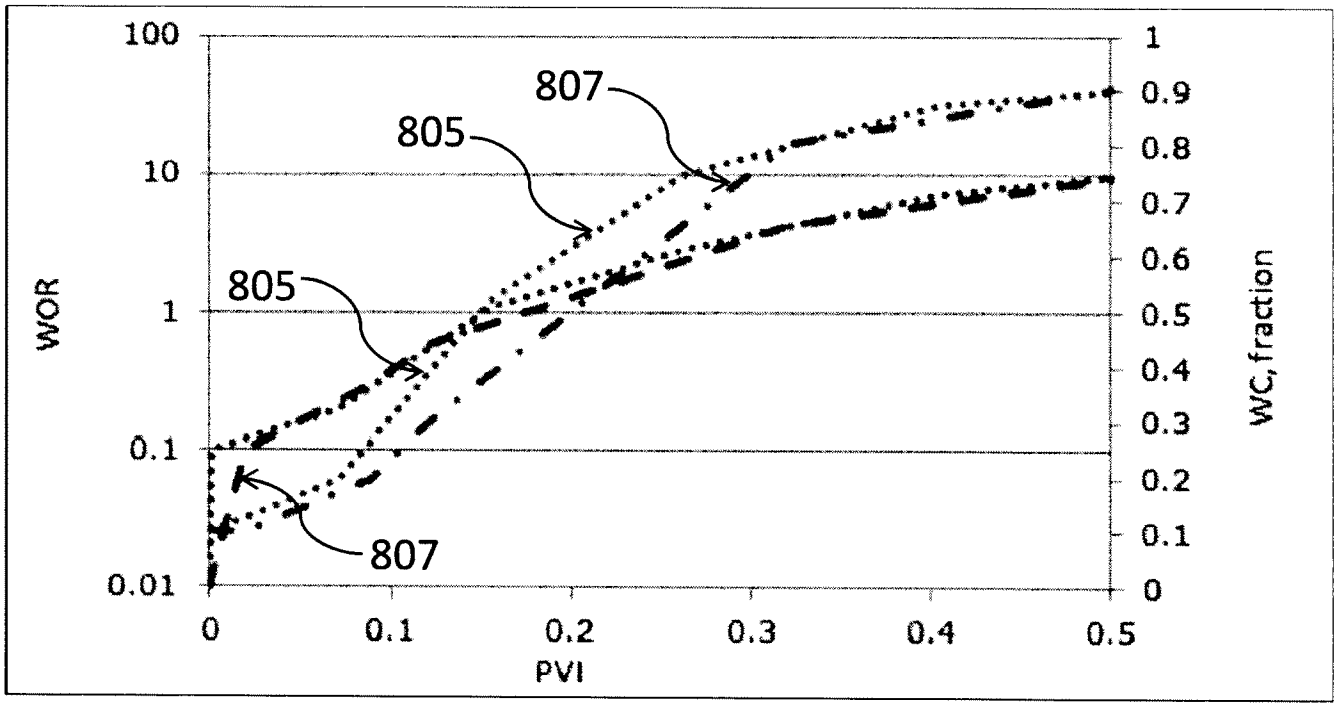
Figure 14:
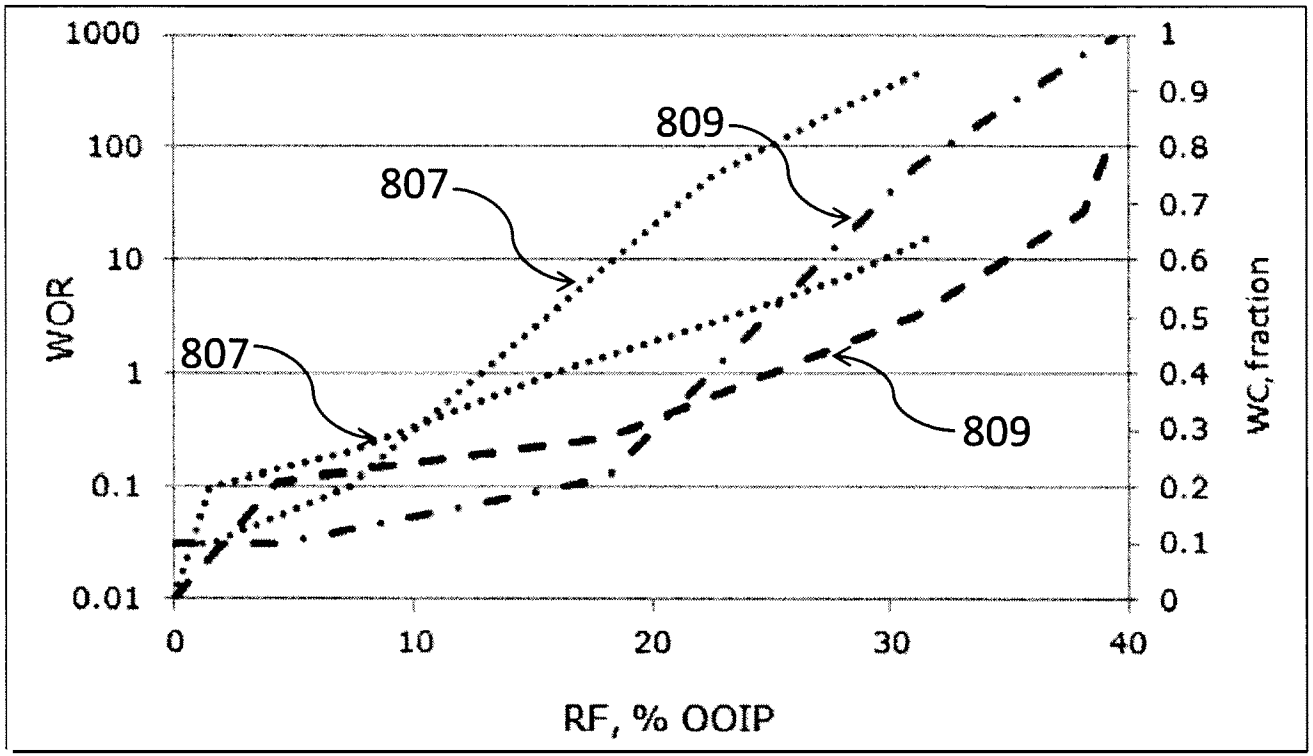
Figure 15:
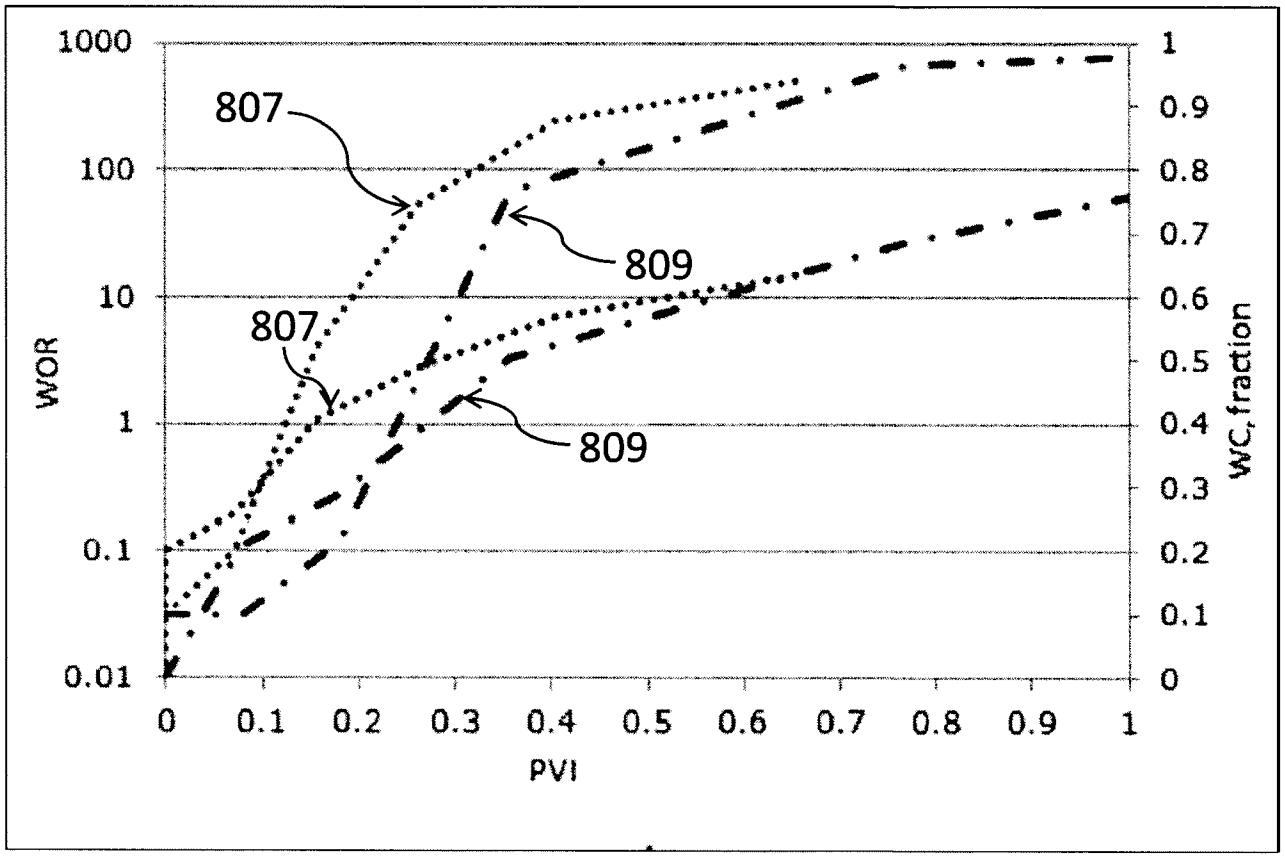

FIGS. 12-15 illustrate how the water flooding performance system 104 can be used to identify possible analog reservoirs with similar water production performance. In particular, FIGS. 12 and 13 compare the water production performance of reservoir 805 and reservoir 807. The water-oil ratio and water cut versus recovery factor curves in FIG. 12 are in good agreement for reservoir 805 and reservoir 807. Similarly, the water-oil ratio and water cut versus pore volumes injected curves in FIG. 13 are also in good agreement for reservoir 805 and reservoir 807. Accordingly, the comparison of the water production performance indicates that reservoir 805 and reservoir 807 may be good analogs for each other. FIGS. 14 and 15 compare the water production performance of reservoir 807 and reservoir 809. The water-oil ratio and water cut versus recovery factor curves in FIG. 14 are not in good agreement for reservoir 807 and reservoir 809. Similarly, the water-oil ratio and water cut versus pore volumes injected curves in FIG. 15 are also not in good agreement for reservoir 807 and reservoir 809. Accordingly, the comparison of the water production performance indicates that reservoir 807 and reservoir 809 are not good analogs for each other.

Water flooding performance system 104 can also be used to estimate a Gross Injection Factor. The Gross Injection Factor is defined as the additional volume of water needed to be injected to account for water loss, such as loss of water to an aquifer or beyond the limits of the reservoir. For example, a typical water loss for peripheral floods ranges between 0.1 (10%) and 0.6 (60%), whereas for pattern injection schemes a typical water loss ranges between 0.1 (10%) and 0.4 (40%). The estimated total pore volumes injected (PVI) expected to be effective injection for recovering the estimated volumes of oil often does not account for water loss. Accordingly, the Gross Injection Factor can be used to determine the incremental amount of water needed to account for such water loss.

Figure 16:
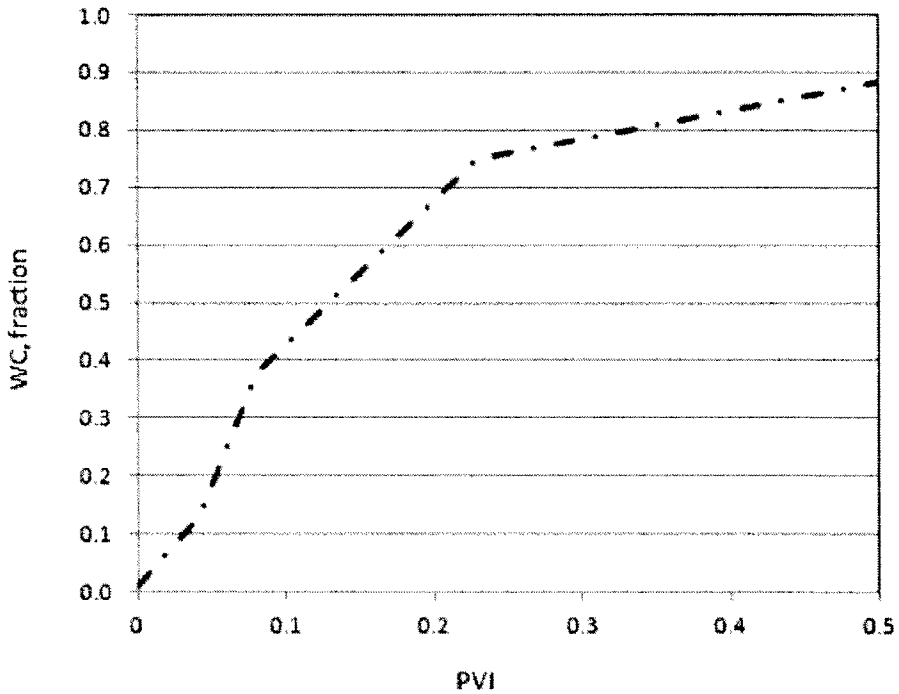
FIG. 16 shows a plot of water production performance where a water cut of 0.88 (88%) is obtained at an effective PVI of 0.5 (50%).

FIG. 16 shows a plot of water production performance where a water cut of 0.88 (88%) is obtained at an effective PVI of 0.5 (50%). Assuming there is a water loss of 0.33, which is the median value for a typical peripheral flood, the Gross Injection Factor can be calculated as:

$$GIF = \frac{0.5}{(1 - 0.33)} \cong 0.75$$

From this calculation, it can be deduced that about 75% of gross pore volumes will be required to obtain the expected effective injection of 50% pore volumes. Higher gross pore volumes to be injected will be needed if a higher water loss, such as to an aquifer, is expected. Accordingly, a water loss closer to the observed maximum of 60% might be used to calculate the Gross Injection Factor for a peripheral flood. Similarly, lower gross pore volumes to be injected will be needed if a lower water loss is expected. Accordingly, a water loss closer to the observed minimum of 10% might be used to calculate the Gross Injection Factor in this case.

Figure 17:
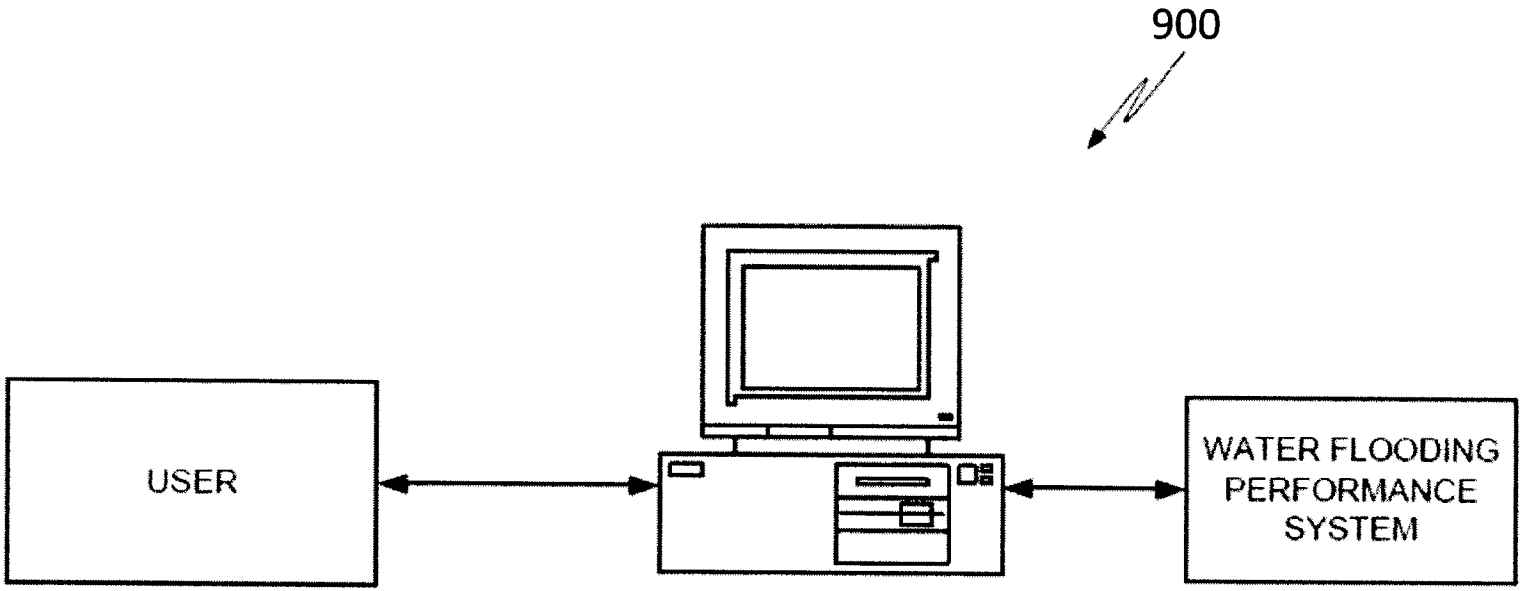
FIG. 17 depicts a computer-implemented environment wherein users can interact with water flooding performance system hosted on a stand-alone computer system.

This written description uses examples to disclose the invention, including the best mode, and also to enable a person skilled in the art to make and use the invention. The patentable scope of the invention may include other examples. As an example, a computer-implemented system and method can be configured as described herein to provide results for identification of water flooding candidates, evaluation of reservoir performance, risk predictions, and use in decision analysis. As another example, a computer-implemented system and method can be configured to allow multiple executions of the system and method. As another example, a computer-implemented system and method can be configured such that water flooding performance system can be provided on a stand-alone computer for access by a user, such as shown at 900 in FIG. 17.

As another example, the systems and methods may include data signals conveyed via networks (e.g., local area network, wide area network, internet, combinations thereof, etc.), fiber optic medium, carrier waves, wireless networks, etc. for communication with one or more data processing devices. The data signals can carry any or all of the data disclosed herein that is provided to or from a device.

Additionally, the methods and systems described herein may be implemented on many different types of processing devices by program code comprising program instructions that are executable by the device processing subsystem. The software program instructions may include source code, object code, machine code, or any other stored data that is operable to cause a processing system to perform the methods and operations described herein. Other implementations may also be used, however, such as firmware or even appropriately designed hardware configured to carry out the methods and systems described herein.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The systems and methods may be provided on many different types of computer-readable media including computer storage mechanisms (e.g., CD-ROM, diskette, RAM, flash memory, computer's hard drive, etc.) that contain instructions (e.g., software) for use in execution by a processor to perform the methods' operations and implement the systems described herein.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

It should be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Finally, as used in the description herein and throughout the claims that follow, the meanings of "and" and "or" include both the conjunctive and disjunctive and may be used interchangeably unless the context expressly dictates otherwise; the phrase "exclusive or" may be used to indicate situation where only the disjunctive meaning may apply.

It is claimed:

1. A computer-implemented method for generating corrected performance data of water flooding of an oil reservoir system, said method comprising:

receiving, through one or more data processors, data related to properties of the oil reservoir system and data related to a water flooding scenario;

applying, through the one or more data processors, at least one analytical water flooding performance computation methodology to the data related to properties of the oil reservoir system and the data related to the water flooding scenario to generate water flooding performance data; and applying, through the one or more data processors, a statistical correction factor methodology to the generated water flooding performance data to generate corrected water flooding performance data wherein applying the statistical correction factor methodology to the generated water flooding performance data includes adjusting a time for initial oil production and a time for oil production rate to peak of the generated water flooding performance data;

wherein the corrected water flooding performance data is representative of oil recovery by the water flooding of the oil reservoir system.

2. The method of claim 1, wherein the data related to the water flooding scenario includes: data related to properties of water used in the water flooding of the oil reservoir system, and injection data from the water flooding of the oil reservoir system;

wherein the data related to properties of the oil reservoir system includes: water saturation, residual saturation, residual oil saturation, residual gas saturation, initial oil saturation, initial gas saturation, initial water saturation, oil viscosity, oil formation volume factor, pattern area, reservoir thickness, porosity, the distance between wells, reservoir pressure drop, the number of reservoir layers, average permeability, transmissibility, and reservoir pressure.

3. The method of claim 1, wherein the at least one analytical water flooding performance computation methodology comprises one or more of: the Modified Buckley-Leverett methodology, the Craig-Geffen-Morse methodology, the Dykstra-Parsons methodology, and the Stiles methodology.

4. The method of claim 1, wherein the statistical correction factor methodology comprises a modified Bush-Helander methodology.

5. The method of claim 4, wherein the corrected time for initial oil production response is determined in the statistical correction factor methodology according to the following equation:

$$t_{response}=t_{AM}+t_{BHi},$$

where $t_{response}$ is the corrected time for initial oil production response, $t_{AM}$ is a time for initial oil production determined using the at least one analytical water flooding performance computation methodology, and $t_{Bhi}$ is the time for initial oil production determined using the modified Bush-Helander methodology.

6. The method of claim 5, wherein the corrected oil production rate is determined in the statistical correction factor methodology according to the following equations:

$$q=\begin{cases} q_{shaved}=\dfrac{2q_{AM}}{3} & t_{response}<t_{AMmax}+t_{BHi} \\ q_{shaved}=\dfrac{2q_{AMmax}}{3} & t_{AMmax}+t_{BHi}\le t_{response}\le t_{BHpeak} \\ q_{shaved}=\dfrac{2q_{AM}}{3} & t_{response}>t_{BHpeak}, \end{cases}$$

where $q_{shaved}$ is the corrected oil production rate, $q_{AM}$ is an oil production rate determined using the at least one analytical water flooding performance computation methodology, $t_{AMmax}$ is a time for oil production rate to peak determined using the at least one analytical water flooding performance computation methodology, and $t_{BHpeak}$ is the time for oil production rate to peak determined using the modified Bush-Helander methodology.

7. The method of claim 1, wherein the corrected water flooding performance data comprises at least one corrected recovery efficiency (SCF $E_R$).

8. The method of claim 7, further comprising:

determining a corrected volumetric sweep efficiency (SCF $E_v$) based on the corrected recovery efficiency (SCF $E_R$) and a displacement efficiency ($E_D$);

determining an analytical volumetric sweep efficiency (analytical $E_v$) based on an areal sweep efficiency and a vertical sweep efficiency; and determining whether the analytical volumetric sweep efficiency (analytical $E_v$) is reasonable based on the corrected volumetric sweep efficiency (SCF $E_v$).

9. The method of claim 8, wherein the analytical volumetric sweep efficiency (analytical $E_v$) is determined using Dyes' correlation to calculate the areal sweep efficiency and Dykstra-Parsons correlation to calculate the vertical sweep efficiency.

10. The method of claim 1, further comprising, through the one or more data processors:

generating, a simulated recovery efficiency (simulated $E_R$) by applying numerical simulations to the data related to properties of the oil reservoir system and the data related to the water flooding scenario;

determining a simulated volumetric sweep efficiency (simulated $E_v$) based on the simulated recovery efficiency (simulated $E_R$) and a displacement efficiency ($E_D$);

determining an analytical volumetric sweep efficiency based on an areal sweep efficiency and a vertical sweep efficiency, the areal sweep efficiency and the vertical sweep efficiency being provided in the generated water flooding performance data; and determining whether the simulated volumetric sweep efficiency (simulated $E_v$) is reasonable based on the analytical volumetric sweep efficiency (analytical $E_v$).

11. The method of claim 1, further comprising:

determining, through the one or more data processors, a water-oil ratio and a water cut responsive to the corrected water flooding performance data determined based on application of the statistical correction factor methodology to the generated water flooding performance data.

12. The method of claim 1, further comprising:

determining, through the one or more data processors, a Gross Injection Factor.

13. A computer-implemented method for evaluating performance data of water flooding of an oil reservoir system, said method comprising:

receiving, through one or more data processors, data related to properties of the oil reservoir system and data related to a water flooding scenario;

generating, through the one or more data processors, water flooding performance data including a recovery efficiency by numerical simulations based on the received data related to properties of the oil reservoir system and data related to the water flooding scenario;

determining, through the one or more data processors, a first value of volumetric sweep efficiency from the generated recovery efficiency based on a correlation of volumetric sweep efficiency as a function of recovery efficiency;

determining, through the one or more data processors, a second value of volumetric sweep efficiency based on predetermined correlations of areal sweep efficiency and vertical sweep efficiency; and determining whether the first value of volumetric sweep efficiency is reasonable based on the second value of volumetric sweep efficiency.

14. The method of claim 13, wherein:

the predetermined correlation of areal sweep efficiency comprises the Dyes' correlation of areal sweep efficiency; and the predetermined correlation of vertical sweep efficiency comprises the Dykstra-Parsons correlation of vertical sweep efficiency.

15. A computer-implemented system for generating corrected performance data of water flooding of an oil reservoir system, said system comprising:

one or more data processors;

a computer-readable memory encoded with instructions for commanding the one or more data processors to perform steps comprising:

receiving, through the one or more data processors, data related to properties of the oil reservoir system and data related to a water flooding scenario;

applying, through the one or more data processors, at least one analytical water flooding performance computation methodology to the data related to properties of the oil reservoir system and the data related to the water flooding scenario to generate water flooding performance data; and applying, through the one or more data processors, a statistical correction factor methodology to the generated water flooding performance data to generate corrected water flooding performance data, wherein applying the statistical correction factor methodology to the generated water flooding performance data includes adjusting a time for initial oil production and a time for oil production rate to peak of the generated water flooding performance data;

wherein the corrected water flooding performance data is representative of oil recovery by the water flooding of the oil reservoir system.

16. The system of claim 15, wherein the corrected water flooding performance data comprises at least one corrected recovery efficiency (SCF $E_R$).

17. The system of claim 16, wherein:

the generating water flooding performance data further comprises determining at least one analytical recovery efficiency value (analytical $E_R$) based on predetermined correlations of areal sweep efficiency and vertical sweep efficiency; and the computer-readable memory is encoded with instructions for commanding the one or more data processors to further determine whether the analytical recovery efficiency (analytical $E_R$) is reasonable based on the at least one corrected recovery efficiency (SCF $E_R$).

18. The system of claim 16, wherein the computer-readable memory encoded with instructions for commanding the one or more data processors to perform further steps comprising:

generating, a simulated recovery efficiency (simulated $E_R$) by applying numerical simulations to the data related to properties of the oil reservoir system and the data related to the water flooding scenario; and determining whether the simulated recovery efficiency (simulated $E_R$) is reasonable based on the at least one corrected recovery efficiency (SCF $E_R$).

19. The system of claim 15, wherein the at least one analytical water flooding performance computation methodology comprises one or more of: the Modified Buckley-Leverett methodology, the Craig-Geffen-Morse methodology, the Dykstra-Parsons methodology, and the Stiles methodology.

20. The system of claim 15, wherein the statistical correction factor methodology comprises a modified Bush-Helander methodology.

21. A non-transitory computer-readable storage medium encoded with instructions for commanding one or more data processors to perform a method for generating corrected performance data of water flooding of an oil reservoir system, said method comprising:

receiving, through one or more data processors, data related to properties of the oil reservoir system and data related to a water flooding scenario;

applying, through the one or more data processors, at least one analytical water flooding performance computation methodology to the data related to properties of the oil reservoir system and the data related to the water flooding scenario; and applying, through the one or more data processors, a statistical correction factor methodology to the generated water flooding performance data, to generate corrected water flooding performance data, wherein applying the statistical correction factor methodology to the generated water flooding performance data includes adjusting a time for initial oil production and a time for oil production rate to peak of the generated water flooding performance data;

wherein the corrected water flooding performance data is representative of oil recovery by the water flooding of the oil reservoir system.

* * * * *